US006758180B2

(12) United States Patent
Pierik

(10) Patent No.: US 6,758,180 B2
(45) Date of Patent: Jul. 6, 2004

(54) PINLESS ROLLER FINGER FOLLOWER

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 116 days.

(21) Appl. No.: 10/004,767

(22) Filed: Dec. 4, 2001

(65) Prior Publication Data

US 2003/0101954 A1 Jun. 5, 2003

(51) Int. Cl.[7] ..... F01L 1/18
(52) U.S. Cl. ..... 123/90.39; 123/90.43; 123/90.45
(58) Field of Search ..... 123/90.43, 90.44, 123/90.45, 90.39

(56) References Cited

U.S. PATENT DOCUMENTS 4,724,803 A * 2/1988 Williams ..... 123/90.39
5,189,997 A * 3/1993 Schneider ..... 123/90.16
5,819,694 A * 10/1998 Trutescu et al. ..... 123/90.43

FOREIGN PATENT DOCUMENTS

| | | | |
|---|---|---|---|
| DE | 3247026 | 6/1984 | |
| EP | 0412237 | 2/1991 | |
| EP | 0517981 | 12/1992 | |
| GB | 209685 | 1/1924 | |
| JP | 04339111 A * | 11/1992 | ..... F01L/1/18 |

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A roller finger follower includes a body having a longitudinal axis, a first end and a second end. A first side member and a second side member are generally parallel with the longitudinal axis and interconnect the first and second ends. A roller seat is defined at least in part by the first and second side members.

24 Claims, 3 Drawing Sheets

PINLESS ROLLER FINGER FOLLOWER

TECHNICAL FIELD

The present invention relates to roller finger followers for use in valve trains of internal combustion engines.

BACKGROUND OF THE INVENTION

Valve trains of internal combustion engines typically include a roller finger follower for transferring rotary motion of a camshaft and/or lobe thereof to actuation of one or more engine valves. A conventional roller finger follower includes a body that carries a roller. One end of the body engages a lash adjuster and the other end engages a valve stem. The cam lobe engages the roller, causing the roller finger follower body to pivot about the lash adjuster and thereby actuate the associated valve.

The roller is disposed between the ends of the body, and between opposing sides of the body that space apart and interconnect the ends. The roller is typically annular in shape and defines an axially-directed orifice through which a shaft extends. The shaft is coupled to the opposing sides of the body to thereby couple the roller to the body. Thus, the sides of the body are disposed on either side of the roller, perpendicular to the central axis thereof. The sides of a conventional roller finger follower body are typically two to five millimeters in thickness or width. Needle bearings are generally required between the shaft and central roller orifice in order to reduce friction between the shaft and roller.

Automotive original equipment manufacturers and suppliers are continually striving to reduce component costs, complexity, and size. However, the widths of the body sides add substantially to the overall width of a conventional roller finger follower. Further, the shaft must be coupled or attached, such as, for example, by being disposed in bores formed in or being welded to, the sides of the body. Thus, assembly and/or manufacture of a conventional roller finger follower is a relatively complex process involving a plurality of component parts.

Therefore, what is needed in the art is a roller finger follower having a reduced width.

Furthermore, what is needed in the art is a roller finger follower having fewer component parts.

Moreover, what is needed in the art is a roller finger follower that is relatively simple to manufacture.

SUMMARY OF THE INVENTION

The present invention provides a roller finger follower for use in a valve train of an internal combustion engine.

The invention comprises, in one form thereof, a body having a longitudinal axis, a first end and a second end. A first side member and a second side member are generally parallel with the longitudinal axis and interconnect the first and second ends. A roller seat is defined at least in part by the first and second side members. Further, a retaining clip is snap fit on the body and includes leg members that are coupled together with a cross member.

An advantage of the present invention is that the overall width relative to a conventional roller finger follower is substantially reduced.

A further advantage of the present invention is that relative to a conventional roller finger follower the number of component parts is reduced.

A still further advantage of the present invention is that it is relatively simple to manufacture.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Figure 1:
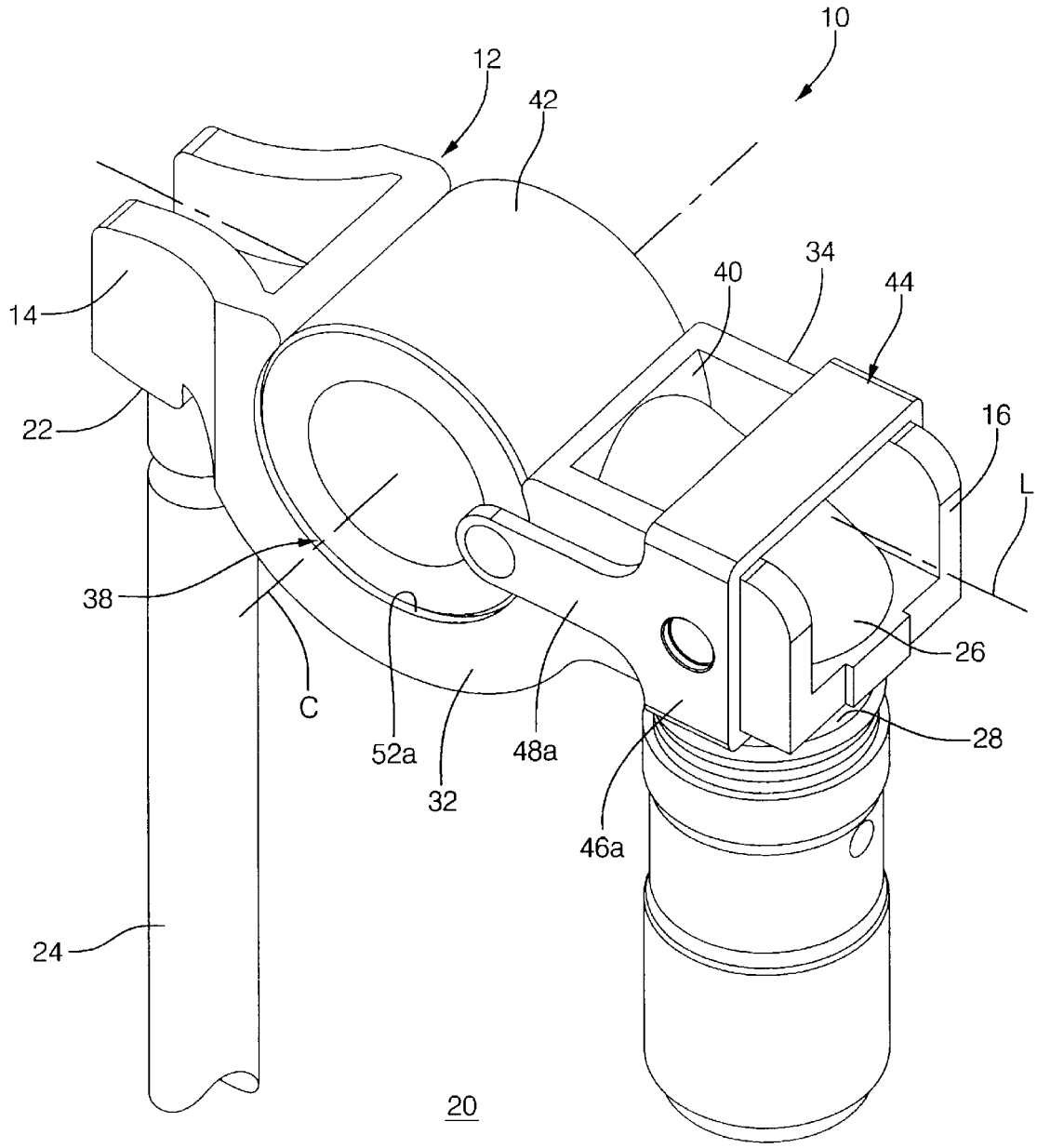
FIG. 1 is a perspective view of one embodiment a roller finger follower of the present invention.

Referring now to the drawings, and particularly to FIG. 1, there is shown one embodiment of a roller finger follower (RFF) of the present invention. RFF 10 includes body 12 having first end 14 and second end 16. Body 12 is generally centered relative to longitudinal axis L, which extends from first end 14 to second end 16. Body 12 is constructed of, for example, steel or aluminum. Preferably, body 12 is manufactured by stamping. RFF 10 is operably installed in engine 20. First end 14 defines a valve seat 22 that receives valve stem 24 of engine 20. Second end 16 defines a semi-spherical lash adjuster socket 26 that receives lash adjuster stem 28.

Body 12 further includes first side member 32 and second side member 34, each of which are interconnected with and space apart first and second ends 14, 16. More particularly, first and second side members 32, 34, each extend in a substantially parallel manner relative to longitudinal axis L between first and second ends 14, 16. Each of first and second side members 14, 16 define, in part, a substantially semi-cylindrical roller seat 38. Roller seat 38 preferably includes roller seat bottom 40 that, as is described more particularly hereinafter, extends between and is attached to or integral with each of first and second side members 32, 34. Thus, first and second side members 32, 34 and roller seat bottom 40 conjunctively define roller seat 38.

Roller 42 has a central axis C, and is received and rotatably disposed within roller seat 38 such that central axis C is generally perpendicular to longitudinal axis L. Roller 42 is configured as a conventional hollow roller. Alternatively, roller 42 is configured as a solid roller constructed of, for example, substantially cylindrical bar stock of, for example, aluminum or steel. Roller seat 38 substantially precludes movement of roller 42 in the direction of longitudinal axis L, i.e., in the direction toward and away from first and second ends 14, 16. The interface of roller 42 and roller seat 38 is lubricated, such as, for example, by engine oil, to thereby reduce friction between roller 42 and roller seat 38 and thereby ensure generally frictionless rotation of roller 42 within roller seat 38.

Retaining clip 44 precludes movement of roller 42 in a direction generally parallel to central axis C. Retaining clip 44 includes L-shaped leg members 46*a*, 46*b* and arms 48*a*, 48*b* (only one of each shown). Retaining clip 44 is coupled, such as, for example, by a snap fit, to second end 16 of body 12. Further, leg members 46*a*, 46*b* are coupled together with a cross member 47. Arms 48*a*, 48*b* extend from retaining clip 44 in a direction generally parallel relative to longitudinal axis L. At least the ends (not referenced) of arms 48*a*, 48*b* are disposed adjacent respective sides of and opposite roller 42 relative to central axis C, to thereby substantially preclude movement of roller 42 in a direction generally parallel to central axis C.

In use, RFF 10 is operably installed in engine 20 such that valve stem 24 is received within valve stem seat 22 and lash adjuster stem 28 is received within lash adjuster socket 26. A cam lobe of a rotary camshaft (neither of which are shown) of engine 20 engages roller 42. Rotation of the cam lobe is transferred by roller 42 to pivotal movement of body 12 relative to lash adjuster stem 28. The pivotal movement of body 12 is, in turn, transferred to valve stem 24 to thereby actuate an associated engine valve. Roller 42 is substantially precluded from movement in the general direction of longitudinal axis L, i.e., in the direction of ends 14, 16, by roller seat 38, and is precluded from movement in the general direction of central axis C by arms 48*a*, 48*b* of retaining clip 44.

It should be particularly noted that side members 32, 34 define semi-circular recesses or arcs 52*a*, 52*b* (only one of which is shown) that define, in part, roller seat 38. Arcs 52*a*, 52*b* are greater than approximately one-hundred degrees, and preferably made approximately equal to or greater than one-hundred and eighty degrees such that roller 42 is retained within roller seat 38 in a direction generally perpendicular to each of central axis C and longitudinal axis L and in a direction generally toward and away from the camshaft when RFF 10 is in use. Most preferably, arcs 52*a*, 52*b* extend from approximately a two-o'clock position to approximately a ten-o'clock position to thereby form a roller seat of approximately two-hundred and forty degrees. It should further be particularly noted that with arcs 52*a*, 52*b* configured as being approximately equal to or greater than one-hundred eighty degrees, roller 42 is assembled into RFF 10 by inserting or "sliding" roller 42 in a direction generally transverse to sides 14 and 16 and into roller seat 38.

RFF 10, in contrast to a conventional roller finger follower, has no shaft and no needle bearings. Thus, the number of component parts of RFF 10 is reduced relative to a conventional roller finger follower, thereby rendering the manufacture and assembly thereof relatively simple. The width of RFF 10 is approximately the same as the width of roller 42. Body 12 of RFF 10 does not project substantially outside of or beyond roller 42 in the direction of central axis C. In contrast, a conventional roller finger follower generally extends from about 2 to about 5 millimeters on each side of its body outside of or beyond the roller. Thus, RFF 10 has a width that is substantially reduced relative to a conventional roller finger follower.

Figure 2:
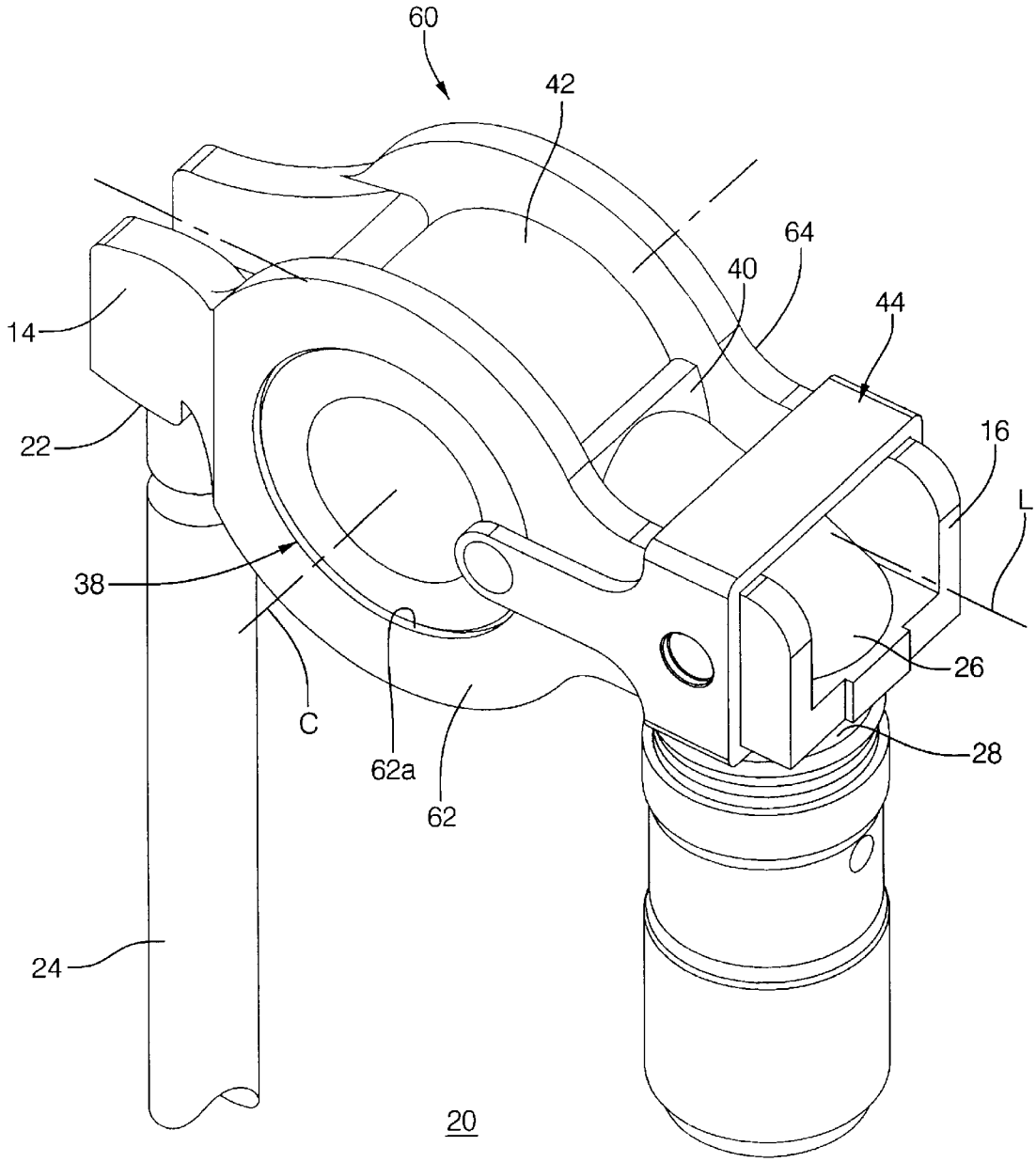
FIG. 2 is a perspective view of a second embodiment of a roller finger follower of the present invention.

Referring now to FIG. 2, a second embodiment of a roller finger follower of the present invention is shown. RFF 60 includes first and second side members 62, 64, that define respective substantially circular orifices 62*a*, 62*b*. Roller seat bottom 40 interconnects first and second side members around opposing portions of the circumferences of orifices 62*a*, 62*b* that lie generally below and/or slightly above central axis C of roller 42 (i.e., in the direction away from the camshaft of engine 12 when RFF 60 is operably installed therein). Thus, roller seat 40 is defined by sides 62, 64 and roller seat bottom 40. A respective end of roller 42 is disposed within each of orifices 62*a*, 62*b*, and thereby movement of roller 42 in the general direction of longitudinal axis L and in the direction toward and away from the camshaft of engine 12 is substantially precluded. Substantially circular orifices 62*a*, 62*b* increase the stiffness and rigidity of the body of RFF 60.

Figure 3:
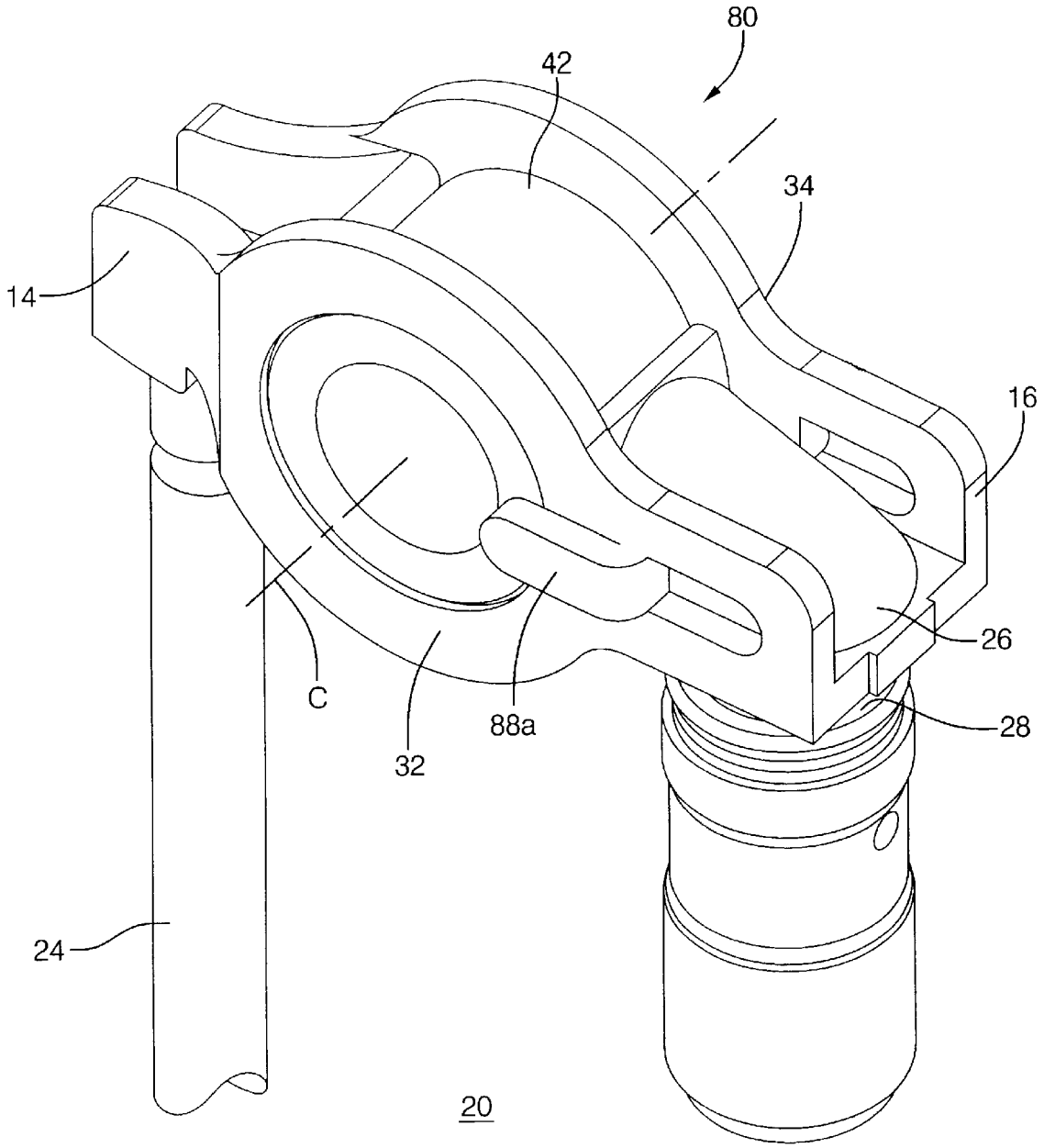
FIG. 3 is a side view of a third embodiment of a roller finger follower of the present invention.

Referring now to FIG. 3, a third embodiment of a roller finger follower of the present invention is shown. RFF 80 eliminates the need for the retaining clip 44 of RFF 10 and RFF 60. In contrast to RFF 10 and RFF 60, side members 32, 34 of RFF 80 include tabs 88*a*, 88*b*, respectively (only one of which is shown). Tabs 88*a*, 88*b* are formed, such as, for example, by stamping, in side members 32, 34 proximate second end 16. Tabs 88*a*, 88*b* are folded or bent over in the direction of first end 14 such that at least a portion of tabs 88*a*, 88*b* are disposed opposite roller 42 relative to central axis C thereof. Tabs 88*a*, 88*b* substantially preclude motion of roller 42 in the direction of central axis C, and thereby retain roller 42 within roller seat 38.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A roller finger follower, comprising:

a body having a longitudinal axis, a first end, a second end, a first side member and a second side member generally parallel with said longitudinal axis and interconnecting said first and second ends;

a roller seat defined at least in part by said first and second side members;

a roller disposed within said roller seat; and a retaining clip, wherein said retaining clip is one of affixed to and integral with said roller finger follower body, and wherein said retaining clip comprises first and second leg members interconnected with first and second arms, said first and second leg members affixed to said roller finger follower body, at least a portion of said first and second arms being disposed opposite respective sides of said roller relative to a central axis thereof, said first and second leg members coupled together by a cross member.

2. The roller finger follower of claim 1, wherein said retainer clip is affixed to said roller finger follower body by a snap fit of said first and second legs over one of said first and second ends of said roller finger follower body.

3. A roller finger follower, comprising:

a body having a longitudinal axis, a first end, a second end, a first side member and a second side member generally parallel with said longitudinal axis and interconnecting said first and second ends;

a roller seat defined at least in part by said first and second side members;

a roller disposed within said roller seat, wherein said first and second side members define respective substantially semi-circular recesses, said roller seat defined at least in part by said recesses, and said recesses being coupled with at least a portion of the periphery of said roller; and a retaining clip that is one of affixed to and integral with said roller finger follower body, wherein said retaining clip comprises first and second leg members interconnected with first and second arms, said first and second leg members affixed to said roller finger follower body, at least a portion of said first and second arms being disposed opposite respective sides of said roller relative to a central axis thereof, said first and second leg members coupled together by a cross member.

4. The roller finger follower of claim 3, wherein said recesses comprise arcs of from approximately one-hundred degrees to approximately three-hundred sixty degrees.

5. The roller finger follower of claim 3, wherein said recesses comprise arcs of from approximately two-hundred forty degrees to approximately three-hundred sixty degrees.

6. The roller finger follower of claim 3, wherein said recesses comprise substantially circular orifices.

7. The roller finger follower of claim 3, further comprising a valve seat defined by said first end.

8. The roller finger follower of claim 3, further comprising a lash adjuster socket defined by said second end.

9. The roller finger follower of claim 3, wherein said roller is a hollow, annular-shaped roller.

10. The roller finger follower of claim 3, wherein said roller is a solid roller.

11. The roller finger follower of claim 3, wherein said retainer clip is affixed to said roller finger follower body by a snap fit of said first and second legs over one of said first and second ends of said roller finger follower body.

12. The roller finger follower of claim 3, wherein said retaining clip comprises a first tab and a second tab formed integrally with a corresponding one of said first and second side members, at least a portion of said first and second tabs being disposed on opposite sides of said roller relative to a central axis thereof.

13. An internal combustion engine, comprising:

at least one valve;

a lash adjuster corresponding to each of said at least one valve; and a roller finger follower corresponding to each of said at least one valve, said roller finger follower including;

a body having a longitudinal axis, a first end engaging a stem of said valve, a second end engaging a stem of said lash adjuster, a first side member and a second side member generally parallel with said longitudinal axis and interconnecting said first and second ends;

a roller seat defined at least in part by said first and second side members;

a roller disposed within said roller seat and engaged by a cam lobe of a camshaft of said engine, wherein said first and second side members define respective substantially semi-circular recesses, said roller seat defined at least in part by said recesses, and said recessed being coupled with at least a portion of the periphery of said roller; and a retaining clip that is one of affixed to and integral with said roller finger follower body, wherein said retaining clip comprises first and second leg members interconnected with first and second arms, said first and second leg members affixed to said roller finger follower body, at least a portion of said first and second arms being disposed opposite respective sides of said roller relative to a central axis thereof, said first and second leg members coupled together by a cross member.

14. The internal combustion engine of claim 13, wherein said recesses comprise arcs of from approximately one-hundred degrees to approximately three-hundred sixty degrees.

15. The internal combustion engine of claim 13, wherein said recesses comprise arcs of from approximately two-hundred forty degrees to approximately three-hundred sixty degrees.

16. The internal combustion engine of claim 13, wherein said recesses comprise substantially circular orifices.

17. The internal combustion engine of claim 13, further comprising a valve seat defined by said first end, a stem of said valve being received within said valve seat.

18. The internal combustion engine of claim 13, further comprising a lash adjuster socket defined by said second end, a stem of said lash adjuster being received within said lash adjuster socket.

19. The internal combustion engine of claim 13, wherein said roller is a hollow, annular-shaped roller.

20. The internal combustion engine of claim 13, wherein said roller is a solid roller.

21. The roller finger follower of claim 13, wherein said retainer clip is affixed to said roller finger follower body by a snap fit of said first and second legs over one of said first and second ends of said roller finger follower body.

22. The roller finger follower of claim 13, wherein said retaining clip comprises a first tab and second tab integral with a corresponding one of said first and second side members, at least a portion of said first and second tabs being disposed on opposite sides of said roller relative to a central axis thereof.

23. An internal combustion engine, comprising:

at least one valve;

a lash adjuster corresponding to each of said at least one valve; and a roller finger follower corresponding to each of said at least one valve, said roller finger follower including;

a body having a longitudinal axis, a first end engaging a stem of said valve, a second end engaging a stem of said lash adjuster, a first side member and a second side member generally parallel with said longitudinal axis and interconnecting said first and second ends;

a roller seat defined at least in part by said first and second side members;

a roller disposed within said roller seat and being engaged by a cam lobe of a camshaft of said engine; and a retaining clip, wherein said retaining clip is one of affixed to and integral with said roller finger follower body, and wherein said retaining clip comprises first and second leg members interconnected with first and second arms, said first and second leg members affixed to said roller finger follower body, at least a portion of said first and second arms being disposed opposite respective sides of said roller relative to a central axis thereof, said first and second leg members coupled together by a cross member.

24. The roller finger follower of claim 23, wherein said retainer clip is affixed to said roller finger follower body by a snap fit of said first and second legs over one of said first and second ends of said roller finger follower body.

* * * * *